US007387106B2

(12) United States Patent
Piciotti et al.

(10) Patent No.: US 7,387,106 B2
(45) Date of Patent: Jun. 17, 2008

(54) INTERNAL COMBUSTION ENGINE THROTTLE VALVE

(75) Inventors: Roberto Piciotti, Bologna (IT); Mario Marconi, Bologna (IT); Giorgio Ferretti, Ferrara (IT); Claudio Fauni, Bologna (IT); Riccardo Nazzaro, Bologna (IT); Stefano Musolesi, Bologna (IT)

(73) Assignee: Magneti Marelli Powertrain S.p.A. (IT)

( * ) Notice: Subject to any disclaimer, the term of this patent is extended or adjusted under 35 U.S.C. 154(b) by 0 days.

(21) Appl. No.: 11/801,685

(22) Filed: May 10, 2007

(65) Prior Publication Data

US 2007/0266992 A1 Nov. 22, 2007

(30) Foreign Application Priority Data

May 11, 2006 (EP) ..... 06425317

(51) Int. Cl.
*F02D 41/00* (2006.01)

(52) U.S. Cl. ..... 123/399; 123/361

(58) Field of Classification Search ..... 123/399, 123/361, 337

See application file for complete search history.

(56) References Cited

U.S. PATENT DOCUMENTS

| | | | | |
|---|---|---|---|---|
| 5,524,289 | A | 6/1996 | Koblitz et al. | 455/182.3 |
| 5,672,818 | A | 9/1997 | Schaefer et al. | 73/118.2 |
| 6,236,199 | B1 | 5/2001 | Irle et al. | 324/207.17 |
| 6,499,461 | B2 * | 12/2002 | Kubota et al. | 123/361 |
| 7,089,911 | B2 * | 8/2006 | Bender et al. | 123/399 |
| 7,093,581 | B2 * | 8/2006 | Wayama et al. | 123/399 |
| 2002/2074890 | | 6/2002 | Byram | 310/233 |
| 2005/0106928 | A1 | 5/2005 | Schroder et al. | 439/404 |
| 2005/0155780 | A1 | 7/2005 | Hannewald | 174/48 |

FOREIGN PATENT DOCUMENTS

| | | | |
|---|---|---|---|
| EP | 2 32 192 | B1 | 4/1989 |
| EP | 0 569 392 | B1 | 10/1997 |
| EP | 1 217 192 | A3 | 6/2002 |
| JP | 2002-285865 | A * | 10/2002 |
| WO | WO 92/13389 | A1 | 8/1992 |

* cited by examiner

*Primary Examiner*—Hieu T Vo
(74) *Attorney, Agent, or Firm*—Woodcock Washburn LLP

(57) ABSTRACT

A throttle valve for an internal combustion engine, the throttle valve having: a valve seat; a throttle disk, which engages the valve seat and is rotated by an electric motor between an open position and a closed position; a gear transmission connecting the electric motor to a shaft of the throttle disk; a position sensor for determining the position of the throttle disk; a housing chamber housing the electric motor, the gear transmission, and the position sensor; and a rigid plate, which is housed inside the housing chamber, and supports a stator of the position sensor, electric terminals of an electric connector, and a connecting printed circuit which connects the stator of the position sensor and the electric motor electrically to the electric terminals of the electric connector.

3 Claims, 2 Drawing Sheets

INTERNAL COMBUSTION ENGINE THROTTLE VALVE

The present invention relates to an internal combustion engine throttle valve.

BACKGROUND OF THE INVENTION

Petrol-fueled internal combustion engines normally comprise a throttle valve for regulating air flow to the cylinders. A throttle valve comprises a valve body housing a valve seat engaged by a throttle disk, which is fitted to a drive shaft and rotated between an open position and a closed position by an electric motor connected to the shaft by a gear transmission. One end of the drive shaft is fitted with a position sensor, which determines the angular position of the drive shaft (i.e. of the throttle disk) to permit feedback control of the electric motor by a control unit.

The position sensor comprises a rotor fitted to the drive shaft, and a stator facing the rotor to determine the angular position of the rotor, and may be a "contact" type (typically comprising a potentiometer), i.e. the rotor and stator are connected mechanically, or a "contactless" type, i.e. with no mechanical connection between the rotor and stator of the position sensor. One example of an inductive "contactless" position sensor commonly used to determine the angular position of the drive shaft of an electronically controlled throttle valve is described in U.S. Pat. No. 6,236,199B1.

The electric motor, the gear transmission, and the position sensor are housed inside a chamber housing the valve body, and which is closed by a removable cover normally made of plastic or metal material. The cover is fitted with an electric connector for connecting the throttle valve electrically to the internal combustion engine electric system; and an inner surface of the cover is fitted with a printed circuit supporting the position sensor stator and the electric connections between the position sensor and the electric connector and between the electric motor and the electric connector.

U.S. Pat. No. 5,672,818B1 describes one example of a throttle valve, in which the position sensor stator is fixed to the housing chamber cover.

Producing a cover of the type described above, however, is extremely complex, in that the cover must be airtight to prevent in-service contamination of the housing chamber by external agents, and must also ensure a high degree of precision in terms of planarity and position of the position sensor stator, to avoid position sensor reading errors.

U.S.2005155780 discloses a cover for a chamber of a housing of a throttle valve, said cover comprising an approximately plate-type carrier carrying a network of conductors which is embodied as a pressed screen and provided with a sensor.

U.S.2005106928 discloses a contact unit including a contact plate and a connection plug for an adjusting device; a position sensor is disposed on the contact plate whose electrical contact results over conductor tracks molded into the contact plate.

SUMMARY OF THE INVENTION

It is an object of the present invention to provide an internal combustion engine throttle valve designed to eliminate the aforementioned drawbacks, and which, in particular, is cheap and easy to produce.

According to the present invention, there is provided an internal combustion engine throttle valve, as claimed in the attached claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
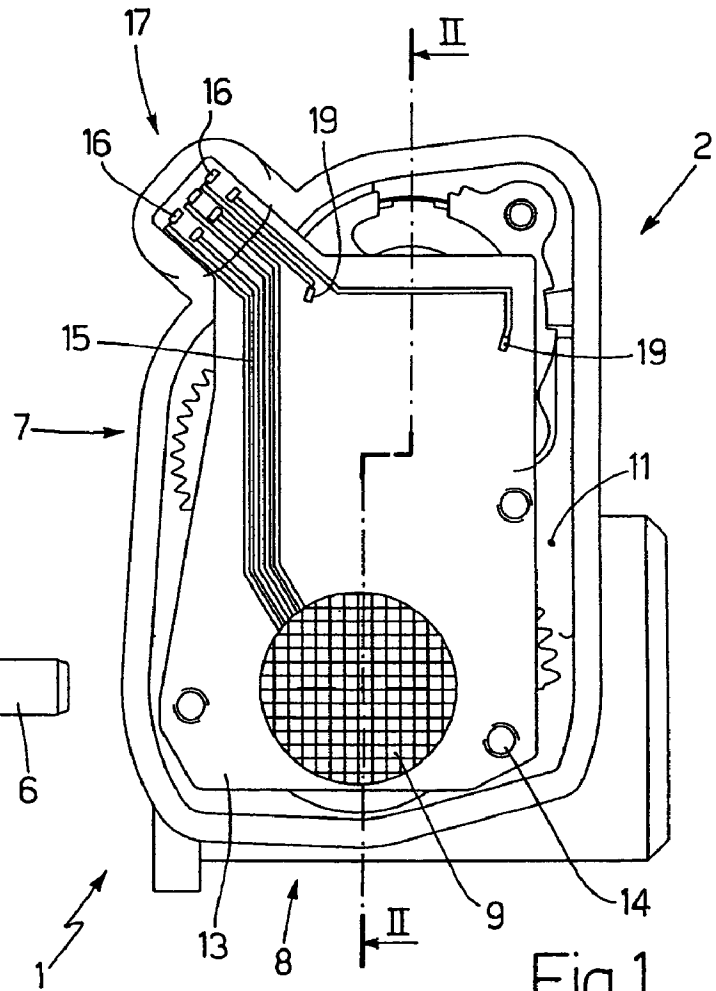
FIG. 1 shows a schematic front view, with parts removed for clarity, of a throttle valve in accordance with the present invention.
Figure 2:
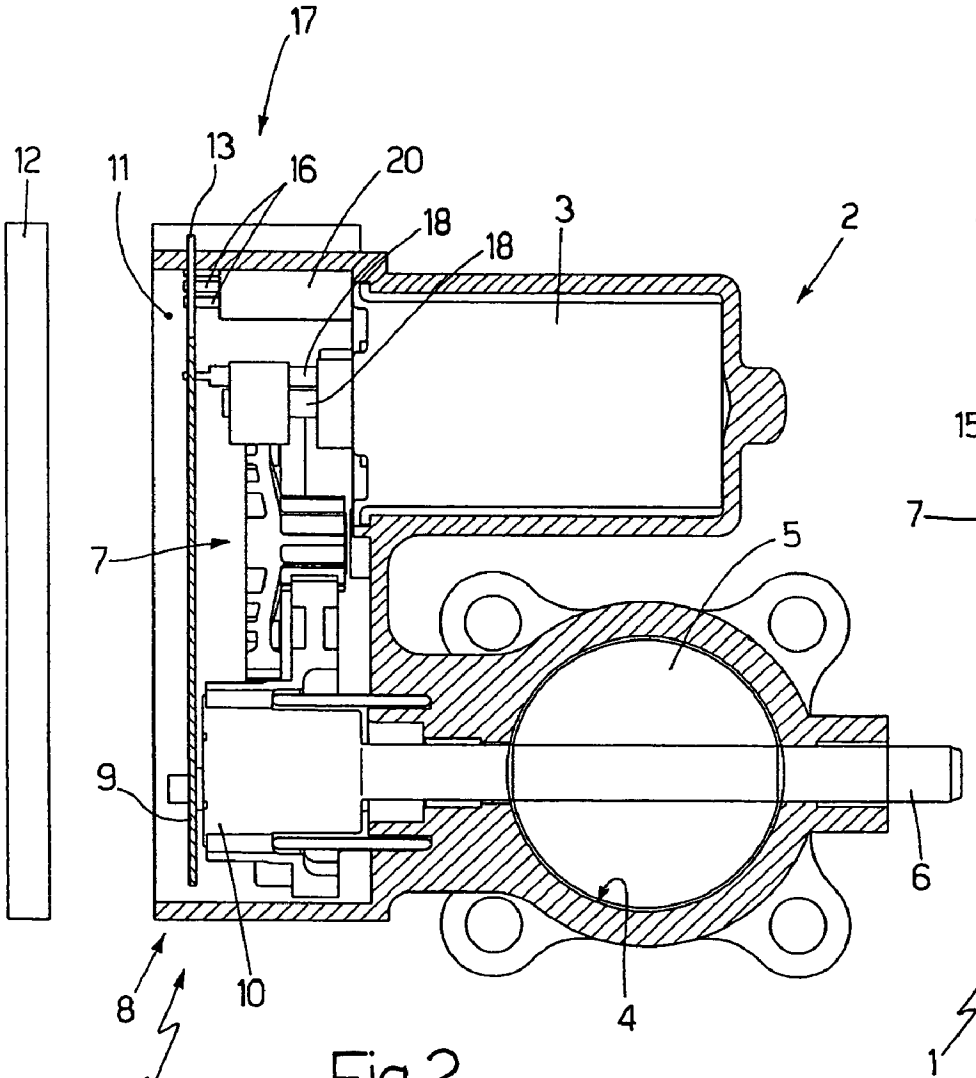
FIG. 2 shows a section, with parts removed for clarity, along line II-II of the FIG. 1 throttle valve.

Number 1 in FIGS. 1 and 2 indicates as a whole a throttle valve for an internal combustion engine. Throttle valve 1 comprises a valve body 2 housing an electric motor 3, a valve seat 4, and a throttle disk 5, which engages valve seat 4 and is moved by electric motor 3 between an open position and a closed position respectively opening and closing valve seat 4. More specifically, throttle disk 5 is fitted to a shaft 6, which is mounted for rotation inside valve body 2 and connected mechanically to electric motor 3 by a gear transmission 7.

Throttle valve 1 also comprises an inductive "contactless" position sensor 8 fitted to shaft 6 to determine the angular position of shaft 6, and therefore of throttle disk 5, to permit feedback control of the position of throttle disk 5. Position sensor 8 is of the type described in U.S. Pat. No. 6,236,199B1, and comprises a stator 9; and a rotor 10 integral with shaft 6 and facing stator 9. More specifically, rotor 10 is defined by a flat metal turn (not shown), which is shorted, has a number of lobes, and is connected to an end gear, integral with shaft 6, of gear transmission 7.

Valve body 2 comprises a housing chamber 11, which houses electric motor 3, gear transmission 7, and position sensor 8, and which is sealed by a removable cover 12 made of plastic or metal material.

A rigid plate 13 is housed inside chamber 11, is fitted to valve body 2 by a number of screws 14, and supports stator 9 of position sensor 8, a connecting printed circuit 15, and the electric terminals 16 of an electric connector 17 for electric connection to the internal combustion engine electric system.

Printed circuit 15 connects stator 9 of position sensor 8 and electric motor 3 electrically to electric terminals 16 of electric connector 17. Electric motor 3 is connected electrically to printed circuit 15 by two rigid metal blades 18, which extend upwards from electric motor 3, perpendicularly to plate 13, and fit inside respective through holes 19 formed through plate 13, or (in a different embodiment not shown) fit inside a specific connector fitted to plate 13.

Electric connector 17 is defined internally by electric terminals 16, and externally by a tubular outer member 20 made of insulating plastic material and which provides for mechanically protecting electric terminals 16, and for establishing mechanical connection to a further electric connector (not shown) of the internal combustion engine electric system, which is connected to electric connector 17.

In the FIGS. 1 and 2 embodiment, outer tubular member 20 of electric connector 17 is an integral part of valve body 2, and is connected to electric terminals 16 when plate 13 is fitted to valve body 2.

Figure 3:
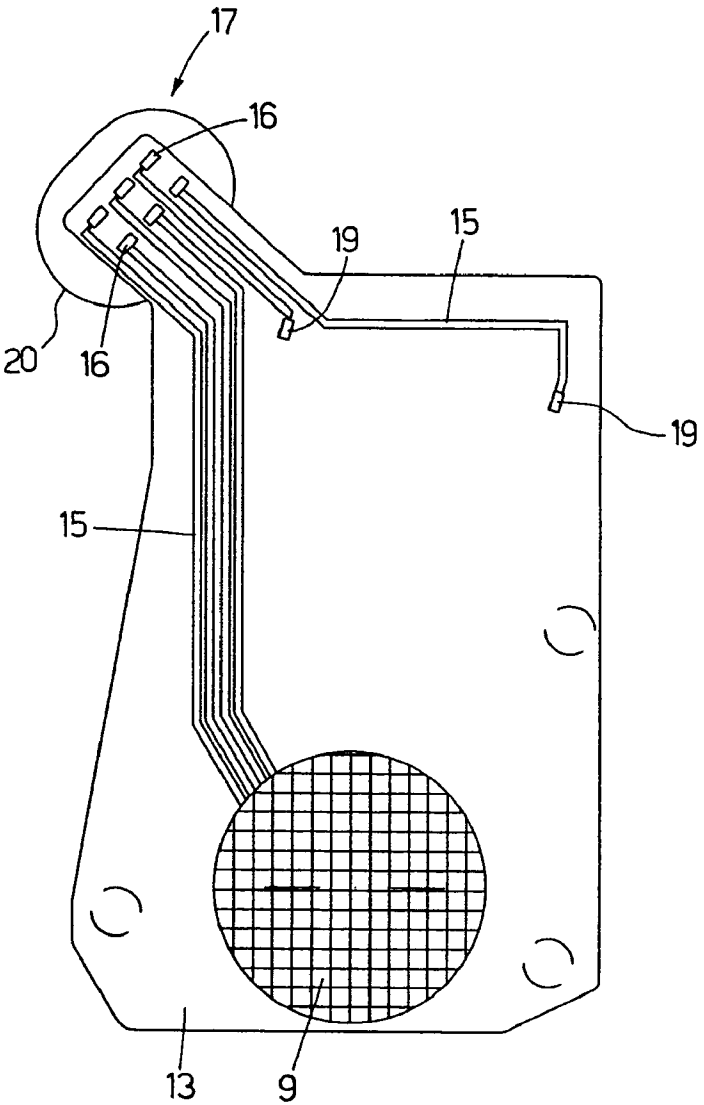
FIG. 3 shows a plan view of an alternative embodiment of a printed circuit of the FIG. 1 throttle valve.
Figure 4:
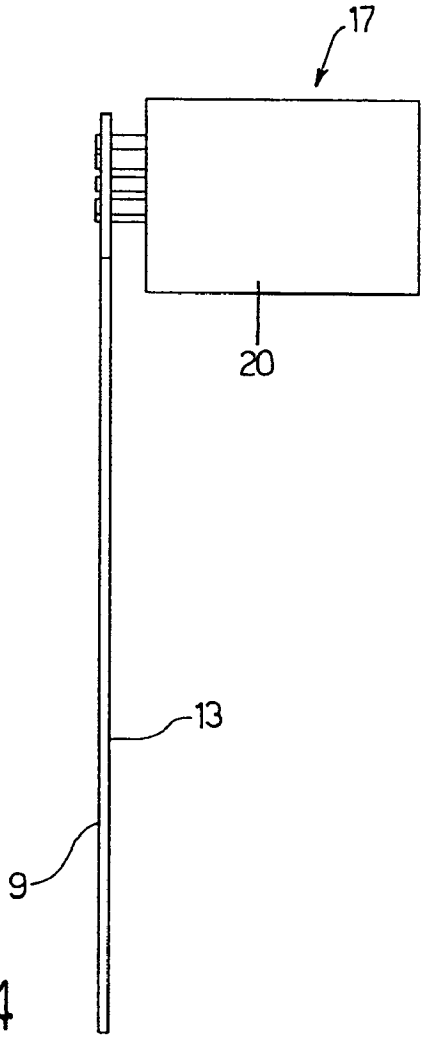
FIG. 4 shows a side view of the FIG. 3 printed circuit.

In the FIGS. 3 and 4 embodiment, outer tubular member 20 of electric connector 17 is fixed to plate 13 and connected permanently to electric terminals 16; and valve body 2 or cover 12 has a groove or through hole (not shown) through which outer tubular member 20 of electric connector 17 fits. This embodiment is compulsory when valve body 2 is made of metal, in which case, it is impossible or at any rate complicated and expensive to incorporate outer tubular member 20 of electric connector in valve body 2.

In an alternative embodiment not shown, printed circuit 15 comprises further electric or electronic components, such as integrated circuits. For example, printed circuit 15 may comprise the electronics driving motor 3, the electronics driving any other actuators and environment sensors, and a data processing unit for controlling throttle valve 1.

Throttle valve 1 as described above is cheap and easy to produce, in particular on account of cover 12 of housing chamber 11 having no electric connections, and simply serving to seal housing chamber 11. This design solution has the twofold advantage of minimizing the total number of electric connections between the various component parts, and any errors as a whole caused by the tolerance chain.

It should be pointed out that reducing the function of cover 12 to that of simply sealing housing chamber 11 allows considerable freedom as regards manufacture of cover 12, which may therefore be designed to minimize production cost.

Once plate 13 is fitted, and before fitting on cover 12, throttle valve 1 can be tested, so that any manufacturing defects can be corrected immediately, by virtue of housing chamber 11 still being accessible. In other words, the mechanical part of throttle valve 1 is only closed and sealed by cover 12 after throttle valve 1 has been tested, thus speeding up correction of any manufacturing defects.

Manufacture of cover 12 no longer involves co-molding metal and plastic parts, thus greatly reducing production cost and improving the reliability of cover 12 as regards protection against external chemical agents.

The invention claimed is:

1. A throttle valve (1) for an internal combustion engine, the throttle valve (1) comprising:

a valve body (2);

an electric motor (3);

a valve seat (4);

a throttle disk (5), which engages the valve seat (4) and is rotated by the electric motor (3) between an open position and a closed position;

a gear transmission (7) connecting the electric motor (3) to a shaft (6) of the throttle disk (5);

a position sensor (8) for determining the position of the throttle disk (5), and comprising a stator (9), and a rotor (10) integral with the shaft (6) of the throttle disk (5);

a housing chamber (11) formed in the valve body (2) and housing the electric motor (3), the gear transmission (7), and the position sensor (8);

a removable cover (12) for sealing the housing chamber (11);

an electric connector (17) being defined internally by electric terminals (16) for electric connection to an electric system of the internal combustion engine, and externally by an outer tubular member (20) made of insulating plastic material and which provides for mechanically protecting the electric terminals (16), and for establishing mechanical connection to a further electric connector of the internal combustion engine electric system; and a rigid plate (13), which is housed inside the housing chamber (11), is connected mechanically to the valve body (2), and supports the stator (9) of the position sensor (8), the electric terminals (16) of the electric connector (17), and a connecting printed circuit (15) which connects the stator (9) of the position sensor (8) and the electric motor (3) electrically to the electric terminals (16) of the electric connector (17);

the throttle valve (1) being characterized in that the outer tubular member (20) of the electric connector (17) is an integral part of the valve body (2), and is connected to the electric terminals (16) when the plate (13) is fitted to the valve body (2).

2. A throttle valve (1) as claimed in claim 1, wherein the electric motor (3) is connected electrically to the printed circuit (15) by two rigid metal blades (18), which extend upwards from the electric motor (3), perpendicularly to the plate (13), and fit inside respective through holes (19) formed through the plate (13).

3. A throttle valve (1) as claimed in claim 1, wherein the printed circuit (15) comprises further electric or electronic components.

* * * * *